United States Patent [19]

Studenroth

[11] 4,194,871

[45] Mar. 25, 1980

[54] ROTARY PISTON INTERNAL COMBUSTION ENGINE

[76] Inventor: Karl E. Studenroth, 1609 Euclid Ave., Chicago Heights, Ill. 60411

[21] Appl. No.: 855,369

[22] Filed: Nov. 28, 1977

[51] Int. Cl.[2] ..... F01C 1/00; F02B 53/00

[52] U.S. Cl. ..... 418/38

[58] Field of Search ..... 123/245; 418/33, 35, 418/36, 38

[56] References Cited

U.S. PATENT DOCUMENTS

| | | | |
|---|---|---|---|
| 1,497,065 | 6/1924 | Brulatour | 418/38 |
| 1,603,630 | 10/1926 | Morris | 418/36 |
| 1,726,461 | 8/1929 | Weed | 418/36 X |
| 2,198,817 | 4/1940 | Heins | 418/36 |
| 2,816,527 | 12/1957 | Palazzo | 418/33 X |

FOREIGN PATENT DOCUMENTS

| | | | |
|---|---|---|---|
| 2032568 | 1/1972 | Fed. Rep. of Germany | 418/38 |
| 314134 | 6/1929 | United Kingdom | 418/36 |

*Primary Examiner*—Michael Koczo

*Attorney, Agent, or Firm*—Gary, Juettner & Pyle

[57] ABSTRACT

The engine of the present invention provides a pair of piston members which rotate intermittently relative to one another within a cylindrical chamber. The piston members' intermittent rotation provides intake, compression, firing and expansion, and exhaust processes for the spaces or chambers formed in the cylindrical chamber between the piston members. The engine includes an output shaft and a mechanism for controlling the motions of the piston members relative one another and to translate or convert the non-uniform or intermittent motion of the piston members to a uniform rotation of the output shaft.

17 Claims, 4 Drawing Figures

Fig. 1.
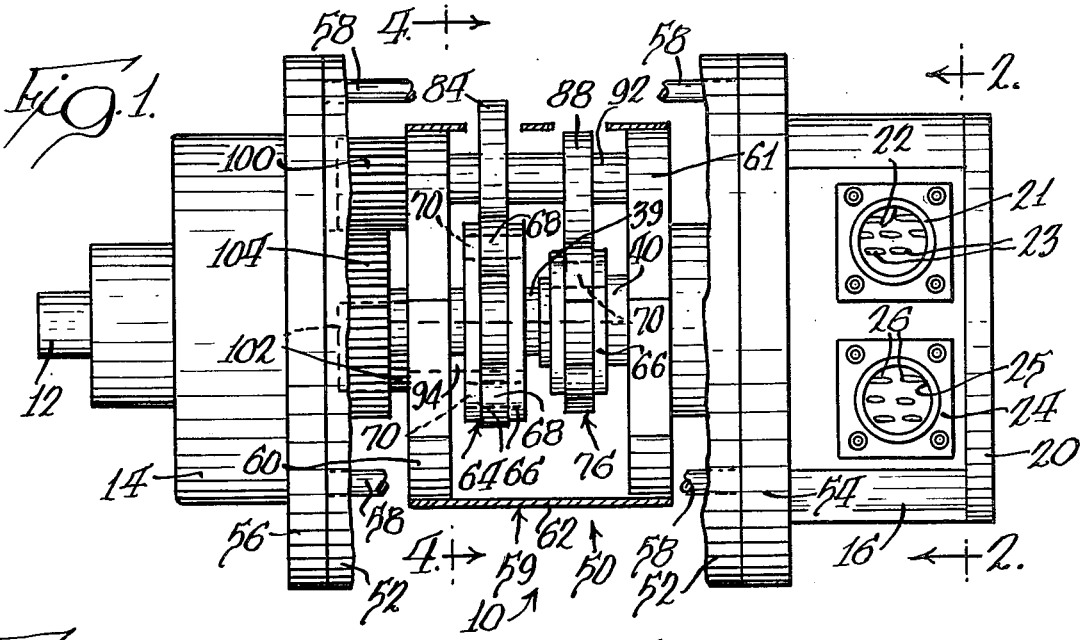
Fig. 2.
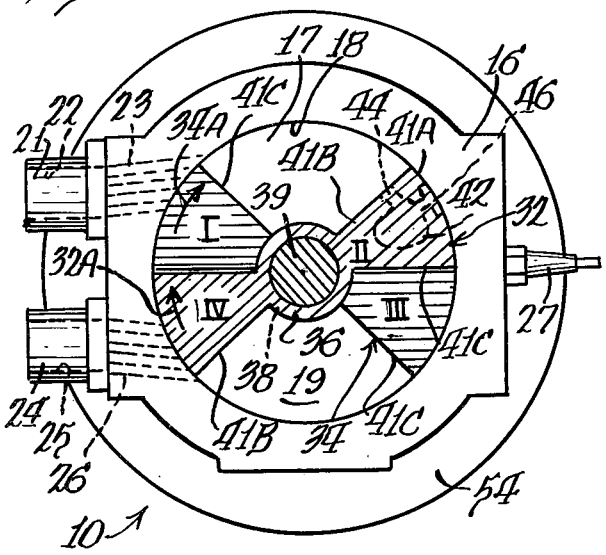
Fig. 4.
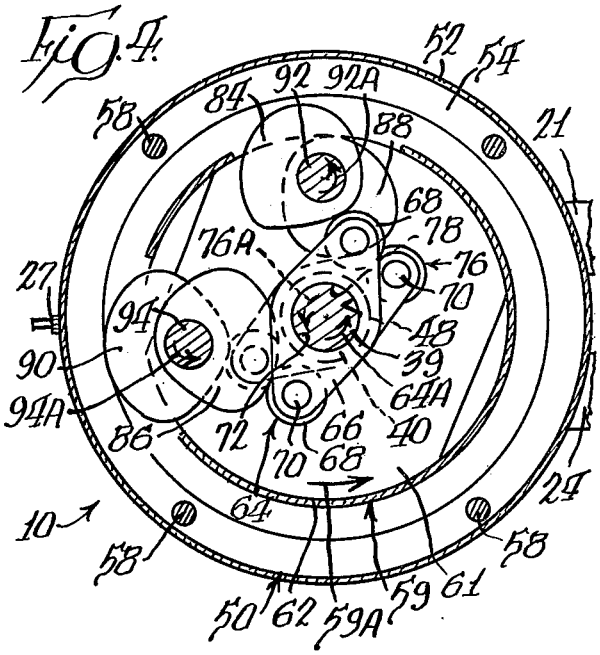
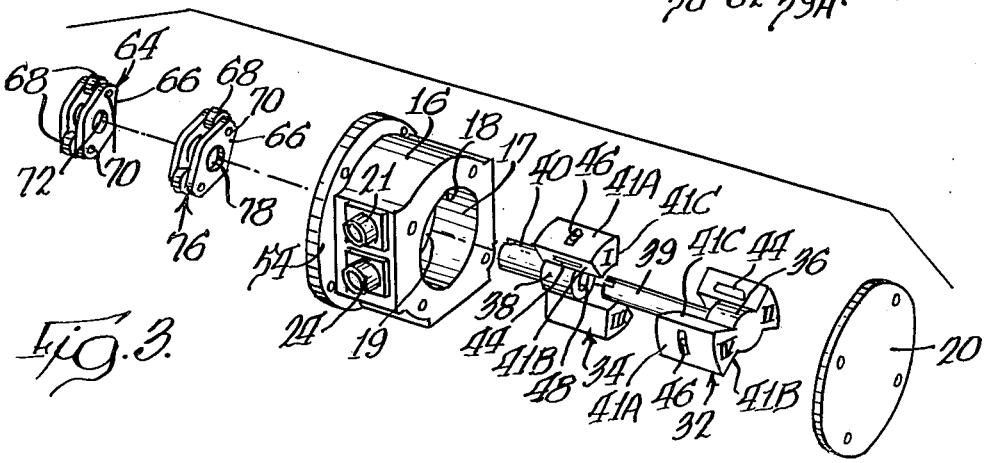
Fig. 3.

ROTARY PISTON INTERNAL COMBUSTION ENGINE

This invention relates to an internal combustion engine having a cylindrical piston chamber containing a pair of rotary piston members rotating with a varying or intermittent motion, and particularly to a mechanism for such engine for controlling the intermittent rotation of such pistons relative to one another and translating such rotation into uniform rotation of the engine's output shaft.

BRIEF SUMMARY OF THE INVENTION

Heretofore, various rotary engines have been developed. The most successful of these to date, the Wankel engine, has an exotically shaped piston rotating in an equally exotically shaped chamber. At least some of the difficulties encountered with this engine, such as its relatively high manufacturing cost, difficulty in sealing, short operating life, and lower efficiency can be traced to the use of such exotic shapes for the piston and chamber.

Heretofore, various type rotary engines have been developed using less exotic shapes. In such engines there are two or more pistons rotating about in a piston chamber, with the combustion chamber being formed between the pistons. The pistons alternatively move faster and then slower in a varying or intermittent manner to change the volume of the combustion chamber for the intake, compression, expansion and exhaust processes. Such type pistons and chambers are shown in my U.S. Pat. No. 3,923,032, which issued on Dec. 2, 1975. While such engine enjoys good sealing, long life, high efficiency and low manufacturing cost, it requires a piston movement mechanism for causing the pistons to move relative one another to carry out the necessary movements for such processes and for converting the varying motion of the pistons to a uniform rotation of the engine's output shaft.

The engine of the present invention comprises pistons, as described in my aforementioned patent, rotating in a cylindrical piston chamber, and such a piston movement mechanism. In greater detail, the engine of the present invention includes a block assembly providing a cylindrical chamber, and a pair of piston members rotating in the cylindrical chamber to form at least one variable volume combustion chamber therewith. The engine further includes a driven or output member connected to the engines output shaft, both being rotatably mounted in the block assembly, means for regulating the relative motion between one of the piston members and the driven member, another similar means for regulating the relative motion between the other piston member and the driven member, and still other means for regulating the relative motion of the first and second means with respect to the block assembly. The three means cooperate with the piston and driven members so that, alternatively first one, then the other of the piston members runs faster or ahead and then runs slower or behind the driven member, and the combustion chamber between the piston members undergoes changes in volume to carry out the necessary intake, compression, expansion and exhaust processes of the internal combustion engine, while the driven member rotates steadily.

The first and second means for regulating the motion between the piston members and driven member may comprise cam and follower mechanisms located therebetween. The third means for regulating the motion of the first and second means may comprise gearing in the form of a sun gear held stationary with respect to the block assembly and planetary gears mounted for rotation on the driven member and to rotate the cams of the cam and follower mechanisms.

The aforementioned and other advantages of the rotary engine of the present invention will become apparent from the following written description and accompanying figures of the drawings:

BRIEF DESCRIPTION OF THE DRAWINGS

FIG. 1 is an elevational view of the rotary piston engine of the present invention, with portions of the engine broken away to better illustrate the piston movement mechanism;

FIG. 2 is a cross-sectional view taken along the line 2—2 of FIG. 1 showing the components of the engine in a similar position as in FIG. 1;

FIG. 3 is a reduced size, exploded view, showing some of the components of the engine; and FIG. 4 is a cross-sectional view taken along the line 4—4 of FIG. 1, showing the components of the engine in a similar position as in FIG. 1.

DESCRIPTION OF THE PREFERRED EMBODIMENT

Referring to FIG. 1, the internal combustion engine of the present invention comprises a block assembly 10 which can be secured by means (not shown) to, for example, a vehicle chassis or a platform. Extending from the left side of the assembly is an output shaft 12 which may be adapted to be connected to drive another device (not shown), such as a transmission of the vehicle. The end of shaft 12 could also be connected to drive a cooling fan (not shown) and accessory equipment (not shown) of such vehicle. In addition, the assembly 10 has an auxiliary drive section 14 for driving necessary engine components, such as a distributor of a spark ignition engine, or a fuel injection pump of a compression ignition engine, such being driven off an internal portion of the shaft 12 in any conventional manner.

As shown in FIGS. 1 and 2 the assembly 10 includes an engine block 16 which is generally cylindrical and is provided with water passages (not shown) therein or cooling fins (not shown) thereon for water or air cooling. Within block 16 is formed a large diameter, cylindrical piston chamber 17 (FIG. 2) having an arcuate wall 18 and annular inner end wall 19. When fully assembled, the open, outer end of the chamber 17, opposite the annular wall 19, is closed off by a flat cylinder head 20 (FIG. 1) secured to the block by fasteners, such as bolts or studs (none being shown). Of course the annular wall 19 and head 20 may also be provided with means for cooling the same. An intake manifold 21 for mounting, for example, a carburetor or a fuel injector (not shown) of a spark ignition engine, is secured to the block 16. An intake passage 22 is provided through the intake manifold, and it can communicate with the chamber 17 through a plurality of small passages 23 (FIG. 2) formed in the block.

Similarly, an exhaust manifold 24 is mounted on the block 16 just below the intake manifold 21. An interior passage 25 of the exhaust manifold also can communicate with the chamber 17 through another plurality of similarly small passages 26 formed in the block. A spark plug 27 (FIG. 2) (or fuel injector for a compression ignition engine) is installed in an opening formed in the block 16 generally opposite the intake and exhaust manifolds so as to be in communication with the chamber 17.

Referring now to FIGS. 2 and 3, piston members 32 and 34 rotate in the chamber 17, and with the walls 18 and 19 thereof and the head 20 form four variable volume combustion chambers between the pistons. To facilitate the description of the operation of the engine later, the piston portions of member 32 are identified by Roman numerals II and IV, and those of member 34 are identified by Roman numerals I and III, as shown in FIGS. 2 and 3. For convenience, the combustion chambers between two pistons will be identified by referring to its two adjacent pistons. Thus, the combustion chamber between pistons I and II will be referred to as I–II. In the form shown, each piston member 32 or 34 comprises two diametrically opposed triangular prism shaped pistons portions II and IV or I and III joined at their apexes to a hub portion 36 or 38. The length of the prism piston portions is twice that of the hub portions, with one hub portion being set off to one side and the other being oppositely offset so that the piston portions interfit, with the axial ends of the hubs in contact and the prism piston portions extending over both hub portions. As was heretofore mentioned, the pistons portions I through IV of members 32 and 34 are generally similar to the pistons described in my U.S. Pat. No. 3,923,032, which is hereby incorporated by reference. Each of the piston portions I through IV have an outer arcuate surface 41A, and a rear radial surface 41B and a front radial surface 41C. The angle between the surfaces 41B and 41C of each piston portion is on the order of forty-five degrees. When assembled in the chamber 17, the ends of the piston portions seal against the wall 19 of the chamber and the head 20, and the arcuate walls 41A seal against the arcuate wall 18. Each piston portion is provided with seals for this purpose similar to those described in my U.S. Pat. No. 3,507,587, which issued on Apr. 21, 1970. Each piston portion has an internal chamber 42 therein which is connected to its associated combustion chamber by a nozzle opening 44 in face 41B, and it also has an outer passage 46 which extends from the chamber 42 through the surface 41A. The chamber 42, opening 44 and passage 46 are more fully described in my first-mentioned patent. As the passage 46 terminates in an arcuate groove extending circumferentially along the piston, the ignition advance, which is determined by the placement of the plug 27 and its relative position with respect to the passage 46 when fired, may be varied with engine load and speed.

As is shown in FIG. 3, the piston member 32 includes a solid shaft 39, and the piston member 34 includes a hollow shaft 40. To insure adequate strength the members 32 or 34 and the shafts 39 or 40 are best integrally forged. An opening 48 (FIG. 3) in the hollow shaft 40 is adopted to receive the shaft 39 of the piston member 32 so that the piston members 32 and 34 may be interfit, as was described. The shafts 39 and 40 extend through the opening in annular wall 19 and are rotatably mounted in the block assembly 10 by bearings (not shown). The members 32 and 34 can rotate relative each other about 90°, to the limit permitted by the radial surfaces 41B and 41C of adjacent piston portions of members 32 and 34 contacting each other. Of course, in the fully assembled engine, such actual contact is prevented.

Referring to FIGS. 1, 3 and 4, the mechanism 50 for causing and controlling the necesssary relative motion between the piston portions I through IV of members 32 and 34, resulting in the changes of volume for the combustion chambers, is located between the auxiliary drive section 14 and the block 16. The mechanism 50 is contained within a cover 52 which fits between a forward partition 54 secured to the rear of the block 16 and a rear partition 56 secured to the auxiliary drive section 14. The partitions 54 and 56 are connected by circumferentially spaced elongated sections 58, which for maximum strength are preferably integrally formed with the partitions.

The mechanism 50 includes a driven, cage shaped, member 59 having circular webs 60 and 61 rotatably mounted about the shafts 39 and 40, the web 60 having an opening to receive the shaft 39 and the web 61 having a somewhat larger opening to receive the larger hollow shaft 40. The webs 60 and 61 are secured together by an outer drum 62 so as to provide a unitary structure or cage which also functions as the flywheel of the engine. The web 60 is either connected to or formed integral with the output shaft 12. The shaft 39 may be pivoted in the inner end of shaft 12, or vice versa if desired.

Mechanism 50 further includes first means for regulating the relative motion between the piston member 32 and the driven member 59, second means for regulating the relative motion between the piston member 34 and the driven member, and a third means for regulating the motion of the first and second means relative each other and/or the assembly 10. All three means cooperating to provide the necessary motion to the pistons and output shaft.

The first-mentioned means comprises a cam and follower mechanism operating between the piston member 32 and driven cage member 59. As shown in FIGS. 1 and 3, this mechanism includes a follower assembly 64. The follower assembly 64 includes a pair of side plates 66 carrying a pair of roller bearing followers 68 mounted on heavy pins 70 secured to and extending between the side plates. The rollers 68 are equally spaced about a central hub opening 72 through which extends the solid shaft 39 of the member 32. The follower assembly 64 is non-rotatably secured adjacent the left end of the shaft 39 and located adjacent the web 60, as shown in FIG. 1.

The second means also includes a follower assembly 76, which is similar to the follower assembly 64, except for the larger diameter opening 78 provided to accommodate the larger diameter of hollow shaft 40. The follower assembly 76 is secured to the left end of the shaft 40 between the follower assembly 64 and the circular web 61, as shown in FIG. 1.

The first means also includes a holding cam element 84 and a pusher cam element 86 which operate against the opposite rollers of the follower assembly 64. The second means also includes a holding cam element 88 and a pusher cam element 90 which operate against the opposite rollers of the follower assembly 76. The holding cam elements 84 and 88 are both secured to, or formed integral with, a shaft 92, while the pusher cam elements 86 and 90 are similarly formed on a shaft 94. The shafts 92 and 94 are rotatably mounted in bearings (not shown) in openings provided in the circular webs 60 and 61 of the driven member 59.

Referring to FIG. 1, to sychronize the action of the first and second means, third means is provided, and comprises a pair of planetary gears 100 and 102 which are secured to the ends of the shafts 92 and 94, respectively, and a sun gear 104 non-rotatably affixed to the rear partition 56. The planetary gears engage the sun gears and are one-half the diameter of the sun gear so that the planetary gears 100 and 102, shafts 92 and 94, and cam elements 84, 86, 88 and 90 rotate (counter-clockwise as shown in FIG. 4 by the arrows 92A and 94A), twice around for each revolution of the driven member 59 (that member being driven counter-clockwise in FIG. 4 as shown by the arrow 59A). The driven member 59 can be counter-balanced to compensate for the mass of the gears, shafts and cams thereon.

The profiles of the cam elements 84, 86, 88 and 90 are formed to provide and to control the movements of the piston members 32 and 34 and their pistons I through IV. The members 32 and 34 intermittently rotate clockwise as shown in FIG. 2 by the arrows 32A and 34A. Unlike in a conventional engine, wherein the motion (or rate of change of volume) the pistons undergo are determined strictly by the geometry of the stroke of the crankshaft and piston rod length selected, in the engine of the present invention it is possible to select or alter the pistons' motions to achieve an optimum, such being done by changing the profiles of the cam elements.

For the purposes of description, and not as a limitation, the engine of the present invention will be described as undergoing the following piston motions each revolution. Referring to FIG. 2, during the first portion of a revolution, in which the driven member 59 moves substantially 45 degrees, the piston member 34 and its pistons I and III rotate substantially 90 degrees clockwise, while the piston member 32 and its pistons II and IV substantially stand still so that the forward faces 41C of pistons III and I approach, but do not contact, the rear faces 41B of pistons II and IV. During this portion of the motion, the fuel and air mixture in chamber 42 of piston III (which was ignited sometime earlier when the spark plug 27 was fired while in alignment with the passage 46 of that piston) expand and raise the pressure in chamber 42. The gases escape from chamber 42 of piston III through the nozzle 44 thereof, with jet-like action, to rotate the member 34 and to force chamber II–III to expand. The rising gas pressure in chamber II–III acts on face 41B of piston III, causing shaft 40 to rotate follower assembly 76 (counter-clockwise as shown in FIG. 4 by the dotted arrow 76A) against cam 88 to drive the member 59 counter-clockwise. Since the gas pressure is acting tangentially to the rotation of the piston member, excellent torque is produced.

The same rotation of piston III causes the gases in chamber III–IV to be exhausted and driven out through the passages 26 in the block 16 into the exhaust manifold 24. Also, as piston III rotates, it rotates piston I to compress the air-fuel mixture in chamber I–II into piston II's chamber 42 and to draw a new charge from the intake manifold 21 through the passages 23 into the chamber I–IV.

During the second portion of travel, the piston members 32 and 34 both rotate substantially 45 degrees, as does the driven member 59, so that pistons I and III will be in the positions of pistons II and IV, respectively, as shown in FIG. 2, while pistons II and IV will be in the positions of pistons III and I, respectively, as shown in FIG. 2.

During the third portion of travel, the piston member 32 and its pistons II and IV rotate substantially 90 degrees clockwise, as shown in FIG. 2, while the piston member 34 and its pistons I and III substantially stand still, the driven member again rotating another 45 degrees. During this portion, the gases in piston II's chamber 42 burn and force chamber I–II to expand to drive the member 32 clockwise, as shown in FIG. 2. As the member 32 rotates clockwise, it rotates its follower assembly 64 against cam element 84 to rotate the driven member 59 counter-clockwise, as shown in FIG. 4 by the arrow 64A. With the same movement, piston II drives the exhaust gases from chamber II–III, while piston IV compresses the gases in chamber I–IV into piston I's chamber 42 and draws a new charge into chamber III–IV.

During the fourth portion of travel the piston members 32 and 34 both rotate substantially 45 degrees with the driven member 59, so that pistons I through IV are 180 degrees from the positions shown in FIG. 2 to complete one-half revolution of the engine. The above-described motions of the members 32, 34 and 59 are again repeated, with this time chambers I–IV and III–IV firing, so that the pistons return to the position shown in FIG. 2 to complete one revolution of the engine.

The foregoing varying or intermittent motions of piston members 32 and 34 are undergone while these members, through the first and second means, drive the driven member 59 with uniform rotation. Such is accomplished in the following manner: During the first portion of the movement described above, the driven member 59 rotates forward (counter-clockwise in FIG. 4) 45 degrees, causing the planetary gears 100 and 102 rotating about the sun gear 104 to rotate the cam shafts 92 and 94, counter-clockwise as shown in FIG. 4 by the arrows 92A and 94A, twice as far angularly as the driven member. As cam shafts 92 and 94 rotate, they cause the pusher cam 90 to relatively rotate the member 34 an additional number of degrees ahead, while the driven cam element 84 cause the member 32 to rotate relatively backwards a similar amount so that pistons I and III advance ahead of the driven member 59, while the pistons II and IV fall behind the driven member or substantially stand still. Such occurs because the cam element 90 rotates from a low dwell area to a high dwell area to further advance the member 34, cam element 88 having a complimentary profile permitting such action and maintaining the rollers 68 of follower assembly 76 substantially in contact with both cam elements 88 and 90. At the same time cam element 84 rotates from a high dwell area to a low dwell area to move the member 32 relatively backwards to the driven member, the cam element 94 having a complimentary profile to permit such action and to maintain the follower rollers 68 of assembly 64 in contact with the cam elements 84 and 86.

During the second portion of motion the cam elements 84, 86, 88 and 90 are shaped so as to retain the relative positions for the members 32 and 34 with respect to the driven member so that both piston members rotate 45 degrees with the driven member 59. During the third portion or next 45 degrees rotation of the driven member 59, the cam elements 86 and 88 are shaped to cause the member 32 to rotate 90 degrees while the member 32 essentially stands still. Again the cam elements 84 and 90 have complimentary profiles to keep the follower assemblies 64 and 76 in contact with the cam elements 84 and 86 and 88 and 90, respectively.

Again in the third portion or next 45 degrees rotation of the driven member 59, the cam elements are shaped to cause both members 32 and 34 to rotate the same number of degrees so that the pistons I through IV are 180 degrees from the positions shown in FIG. 2 to complete one-half a revolution. The members 32 and 34 and cam elements provide similar motions during the second half of the revolution so that the pistons return to the positions shown in FIG. 2.

For one revolution of the engine's output shaft 12, each of the pistons I through IV makes a complete revolution, but moves intermittently, to provide an intake, compression, firing and expansion, and exhaust process for the spaces or chambers I–II, II–III, III–IV and IV–I between the pistons. Thus, for one revolution of the engine four, equally spaced power pulses are provided; this accounts for the engines smooth operation. The mass of the rotating driven member 59 and output shaft 12 help further smooth and make uniform the engine's rotation. In addition a single fuel device and/or spark plug can individually serve the four chambers, resulting in improved operation and reduced production and maintenance costs.

While a specific piston motion has been described, it is to be understood that the engine of the present invention can be operated with a different motion. For example, instead of having one piston member stand still while the other rapidly advances, the one also could be made no advance, but at a slower rate than the other.

While only one embodiment of the engine of the present invention has been illustrated and described, it is to be understood that modifications, variations and equivalent structure fall within the scope of the appended claims.

What is claimed is:

1. A rotary piston internal combustion engine comprising a block assembly providing a piston chamber, a first piston member rotatably mounted in said block assembly for non-uniform rotation in said piston chamber, a second piston member rotatably mounted in said block assembly for non-uniform rotation in said piston chamber and cooperating with said first piston member to form at least two variable volume combustion chambers in said piston chamber between said piston members, each of said piston members having at least one piston portion with a hollow chamber therein communicating with its adjacent combustion chamber, a driven member rotatably mounted in said block assembly and having a drive shaft adapted to be connected to drive another device, first means between said first piston member and driven member for regulating and transmitting the rotation of said first piston member, said first means including a first pusher cam, a first holding cam and a pair of first followers, said first pusher and holding cams being mounted on one of said driven member and first piston member, said first pair of followers being mounted on the other of said driven member and first piston member, second means between said second piston member and said driven member for regulating and transmitting the rotation of said second piston member, said second means including a second pusher cam, a second holding cam and a pair of second followers, said second pusher and holding cams being mounted on one of said driven member and second piston member, said second pair of followers being mounted on the other of said driven member and second piston member, said first and second pusher cams being located relatively rotatively behind said first and second pair of followers, respectively, said first and second holding cams being located relatively rotatively ahead of said first and second pair of followers, respectively, and third means in said block assembly for synchronizing the actions of said first and second means, said first, second and third means permitting one of said first and second piston members, then the other, to rotate alternatively ahead, and then behind, said driven member as said driven member is rotated by said piston members, whereby said piston members move relative one another so that at times first one piston member then the other stands still while the other piston member then the first piston member rotates, and said combustion chambers therebetween undergo changes in volume for the intake, compression, expansion and exhaust processes of the internal combustion engine while said driven member and output shaft rotate uniformly.

2. A rotary piston internal combustion engine as in claim 1, wherein said third means comprises a sun gear fixed relative to said block assembly, and a planetary gear rotating about said sun gear and rotatably mounted on said driven member.

3. A rotary piston internal combustion engine comprising a block assembly providing a piston chamber, a first piston member rotatably mounted in said block assembly for non-uniform rotation in said piston chamber, a second piston member rotatably mounted in said block assembly for non-uniform rotation in said piston chamber and cooperating with said first piston member to form at least two variable volume combustion chambers in said piston chamber between said piston members, each of said piston members having at least one piston portion with a hollow chamber therein communicating with its adjacent combustion chamber, a driven member rotatably mounted in said block assembly and having a drive shaft adapted to be connected to drive another device, first means between said first piston member and driven member for regulating and transmitting the rotation of said first piston member, said first means including a first pusher cam, a first holding cam and a pair of first followers, second means between said second piston member and said driven member for regulating and transmitting the rotation of said second piston member, said second means including a second pusher cam, a second holding cam and a pair of second followers, said cams being mounted on said driven member and said pairs of followers being mounted on said piston members, and third means in said block assembly for synchronizing the actions of said first and second means, said first, second and third means permitting one of said first and second piston members, then the other, to rotate alternatively ahead, and then behind, said driven member as said driven member is rotated by said piston members, whereby said piston members move relative one another so that at times first one piston member then the other stands still while the other piston member then the first piston member rotates, and said combustion chambers therebetween undergo changes in volume for the intake, compression, expansion and exhaust processes of the internal combustions engine while said driven member and output shaft rotate uniformly.

4. A rotary piston internal combustion engine comprising a block assembly providing a piston chamber, a first piston member rotatably mounted in said block assembly for non-uniform rotation in said piston chamber, a second piston member rotatably mounted in said block assembly for non-uniform rotation in said piston chamber and cooperating with said first piston member to form at least one variable volume combustion chamber in said piston chamber between said piston members, a driven member rotatably mounted in said block assembly and having a drive shaft adapted to be connected to drive another device, first means between said first piston member and driven member for regulating and transmitting the rotation of said first piston member, second means between said second piston member and said driven member for regulating and transmitting the rotation of said second piston member, each of said first and second means having a cam element and a cooperating follower element, said cam elements being mounted on said driven member and said follower elements being mounted on said piston members and third means in said block assembly for synchronizing the actions of said first and second means, said first, second and third means permitting one of said first and second piston members, then the other, to rotate alternatively ahead, and then behind, said driven member as said driven member is rotated by said piston members, whereby said piston members move relative one another and said combustion chamber therebetween undergoes changes in volume for the intake, compression, expansion and exhaust processes of the internal combustion engine while said driven member and output shaft rotate uniformly.

5. A rotary piston internal combustion engine as in claim 4, wherein said third means comprises a sun gear fixed relative to said block assembly, and at least one planetary gear rotating about said sun gear and rotatably mounted on said driven member, said planetary gear rotatably driving said cam elements of said first and second means.

6. A rotary piston internal combustion engine as in claim 4, wherein each of said piston members carry at least a pair of piston portions, said piston portions on one piston member being adjacent at least one of piston portions on the other piston member.

7. A rotary piston internal combustion engine as in claim 4, wherein one of said piston members has a hollow shaft and the other has a shaft extending through said hollow shaft.

8. A rotary piston internal combustion engine as in claim 4, wherein each of said piston members has two diametrically opposed piston portions, said four piston portions forming four variable volume chambers therebetween, each of said piston portions being hollow and having a chamber and a nozzle in communication with one of said adjacent variable volume chambers.

9. A rotary piston internal combustion engine as in claim 8, wherein each of said piston portions is substantially 45 degrees in arcuate width, first, one of said piston members rotating substantially 90 degrees while the other rotates a lesser amount, second, the piston members then both rotating substantially 45 degrees, third, then the other piston member rotating substantially 90 degrees while the one rotates a lesser amount, and fourth, the piston members then again both rotating substantially 45 degrees to complete one-half a revolution of the engine.

10. A rotary piston internal combustion engine as in claim 4, wherein the first, second and third means change the relative positions of the piston members to the driven member to advance one piston member ahead of the driven member while withdrawing the other piston member behind the driven member, and then retain the relative positions of the piston members to the driven member.

11. A rotary piston internal combustion engine as in claim 4, wherein the first, second and third means alter or retain the relative positions of the piston members with respect to the driven member.

12. A rotary piston internal combustion engine comprising a block assembly providing a piston chamber, a first piston member rotatably mounted in said block assembly for non-uniform rotation in said piston chamber, a second piston member rotatably mounted in said block assembly for non-uniform rotation in said piston chamber and cooperating with said first piston member to form at least one variable volume combustion chamber in said piston chamber between said piston members, one of said piston members having a hollow shaft and the other having a shaft extending through said hollow shaft, a driven member rotatably mounted in said block assembly and having a drive shaft adapted to be connected to drive another device, first means between said first piston member and driven member for regulating and transmitting the rotation of said first piston member, second means between said second piston member and said driven member for regulating and transmitting the rotation of said second piston member, said first and second means including a pair of followers located on the ends of said shafts of said piston members, and a pair of rotatable cams mounted on said driven member, one of said cams engaging one of said followers, and the other cam engaging the other follower, and third means in said block assembly for synchronizing the actions of said first and second means, said first, second and third means permitting one of said first and second piston members, then the other, to rotate alternatively ahead, and then behind, said driven member as said driven member is rotated by said piston members, whereby said piston members move relative one another and said combustion chamber therebetween undergoes changes in volume for the intake, compression, expansion and exhaust processes of the internal combustion engine while said driven member and output shaft rotate uniformly.

13. A rotary piston internal combustion engine as in claim 12, further comprising cooperating timing elements located on said driven member and block assembly.

14. A rotary piston internal combustion engine as in claim 13, wherein said timing elements comprise a sun gear affixed to said block assembly, and a planetary gear engaging said sun gear and driving said cams.

15. A rotary internal combustion engine comprising a block assembly providing a piston chamber, a first piston member rotatably mounted in said block assembly for intermittent rotation in said piston chamber, a second piston member rotatably mounted in said block assembly for intermittent rotation in said piston chamber and cooperating with said first piston member to form at least one variable volume combustion space in said piston chamber between said piston members, a first follower element secured to said first piston member, a driven member rotatably mounted in said block assembly and having a drive shaft extending from said block assembly which is adapted to be connected to drive another device, a first pair of cam elements rotatably mounted on said driven member and cooperating with said first follower element for translating the intermittent rotation of said first piston member to a uniform rotation of the driven member, a second pair of cam elements rotatably mounted on said driven member, a second follower on said second piston member cooperating with said second pair of cam elements for translating the intermittent rotation of said second piston member to uniform rotation of said driven member, a sun gear fixed relative to said block assembly, a pair of planetary gears rotating about said sun gear, each one of said planetary gears rotating one of the cam elements in each of the first and second pair of cam elements, said first and second piston members moving alternatively faster and slower than said driven member, whereby said piston members move relative one another so that the combustion chamber between the piston members undergo changes in volume for intake, compression, expansion and exhaust processes of the engine.

16. A rotary internal combustion engine as in claim 15, wherein said first piston member has an inner shaft and second piston member has a hollow shaft which surrounds and is co-axial with said inner shaft, said inner shaft being longer than said hollow shaft, said inner shaft extending through said hollow shaft, one of said follower elements being mounted on said hollow shaft, and said other follower element being mounted on said inner shaft.

17. A rotary internal combustion engine as in claim 15, wherein said followers extend equally, diametrically from said piston members and carry a pair of rollers at their opposite ends, said rollers engaging said cam elements.

* * * * *